US005750224A

United States Patent [19]

Quasters

[11] Patent Number: 5,750,224

[45] Date of Patent: May 12, 1998

[54] PLASTIC CONTAINER

[75] Inventor: Mikael Quasters, Lidköping, Sweden

[73] Assignee: PLM AB, Malmo, Sweden

[21] Appl. No.: 467,669

[22] Filed: Jun. 6, 1995

Related U.S. Application Data

[62] Division of Ser. No. 107,804, filed as PCT/SE92/00492, Jul 1, 1992 published as WO93/01041, Jan. 21, 1993, abandoned.

[30] Foreign Application Priority Data

Jan. 7, 1992 [SE] Sweden ..... 9102090

[51] Int. Cl.[6] ..... B65D 1/40

[52] U.S. Cl. ..... 428/35.7; 428/36.9; 428/36.92; 428/542.8; 215/379; 215/382; 215/371; 264/532; 264/537

[58] Field of Search ..... 215/370–377, 215/379, 382; 428/36.9, 36.91, 36.92, 542.8, 35.7, 910; 220/606; 264/523, 532, 537

[56] References Cited

U.S. PATENT DOCUMENTS

| | | | |
|---|---|---|---|
| 4,406,854 | 9/1983 | Yoshino | 264/532 |
| 4,465,199 | 8/1984 | Aoki | 215/373 |
| 4,749,092 | 6/1988 | Sugiura et al. | 215/381 |
| 4,755,404 | 7/1988 | Collette | 215/373 |
| 4,954,376 | 9/1990 | Krishnakumar et al. | 215/370 |
| 5,104,706 | 4/1992 | Krishnakumar et al. | 215/375 |
| 5,198,248 | 3/1993 | Krishnakumar et al. | 215/373 |
| 5,236,097 | 8/1993 | Behm et al. | 215/373 |
| 5,244,106 | 9/1993 | Takacs | 215/373 |

FOREIGN PATENT DOCUMENTS

| | | |
|---|---|---|
| 57-113033 | 7/1982 | Japan . |
| 3-39226 | 2/1991 | Japan . |

*Primary Examiner*—Rena Dye

*Attorney, Agent, or Firm*—Pillsbury Madison & Sutro Intellectual Property Group

[57] ABSTRACT

A container, especially a bottle, is made from a preform of polyethylene terephthalate (PET), where the preform has a mouth portion, a substantially conical upper portion extending from the mouth portion, and a cylindrical portion extending from the conical portion towards the bottom of the preform and having a substantially uniform wall thickness. When reshaping the preform, the shoulder of the container is formed substantially only of material which in the preform is located in the conical upper portion of the preform, while the cylindrical portion of the container is formed substantially only of material which in the preform is located in the cylindrical portion of the preform. The expansion of the material in the conical portion of the preform and of the material in the cylindrical portion of the preform is selectively controlled in such a manner that the material in the respective portion undergoes stretching in the axial direction of the preform, defined by the quotient of the axial length of the conical portion of the preform and the axial length of the cylindrical portion of the preform having values in the range 0.25–0.35, and by the quotient of the axial length of the shoulder and the axial length of the cylindrical portion of the container having values in the range 0.60–0.80.

7 Claims, 2 Drawing Sheets

PLASTIC CONTAINER

This is a divisional application of Ser. No. 08/107,804, filed as PCT/SE92/00492, Jul. 1, 1992 published as WO93/01041, Jan. 21, 1993, which is now abandoned.

FIELD OF THE INVENTION

The present invention is directed to the manufacture of plastic containers. The invention also relates to a container produced by means of this method.

BACKGROUND OF THE INVENTION

Plastic containers offer many advantages, e.g., by being lightweight, having a high capacity to withstand mechanical stresses (can be dropped without breaking also when filled), and by involving a low total energy consumption, especially if the containers are recycled. Recycling can be brought about, either by washing the containers and refilling them or by recovering the container material and reshaping it into new articles, such as containers. Plastic containers are well suited to be used from environment aspects, if they are made of plastics which do not contain any substances that are harmful to man, animals or the environment. One example of such plastics is polyethylene zerephthalate (PET).

Polyethylene terephthelate, hereinafter generally referred to as PET, is advantageous in that it can be oriented so as to be given improved mechanical properties. Such orientation enhances the capacity of the material to withstand stretching as well as external stresses in the form of e.g. mechanical impacts. Thus, the amount of material required in the containers can be reduced, which of course contributes to cutting the overall costs for making containers or bottles of PET suited for containing e.g. beverages.

Relevant background art is disclosed in U.S. Pat. Nos. 4,264,558, 4,380,526 and GB-A-2,124,543, describing different techniques for making plastic containers from a blank (preform).

One drawback of oriented PET is that it will shrink if subjected to elevated temperatures. By elevated temperatures is here meant temperatures exceeding the glass transition temperature (Tg) of the material, which for current-grade amorphous material is about 80° C. In oriented material, the softening temperature is however about 10° C. higher. The tendency to shrink can however be eliminated in that the material is stretched at least 1.5 times in the stretching direction concerned. In this manner, the properties of the material are so altered that if the material is maintained at an elevated temperature and at the same time is prevented from shrinking, the tendency of the material to shrink is reduced and at best completely eliminated in a temperature range whose upper limit is slightly below the temperature at which the material is heat-treated. In the heat treatment, the material is relieved of stresses resulting from the stretching of the material, which also undergoes a certain thermal crystallisation at a suitable temperature. To achieve such thermal crystillization, the temperature must exceed about 110° C.

In the amorphous state, PET exhibits no tendency to shrink when heated, but at a temperature exceeding Tg by at least 30° C., the material starts to crystallise thermally. If the thermal crystallisation is allowed to proceed such that the material attains too high a degree of crystallinity, the material becomes brittle and hence unsuitable for use in containers.

Containers of PET withstanding repeated heating to elevated temperatures are well suited for use several times.

PET is in itself resistant to the detergents normally used for cleaning e.g. glass bottles, and so one of the problems to be solved to permit using PET containers in the making of reusable containers, such as returnable bottles, amounts to eliminating the tendency of stretched. PET to shrink when heated. In practice, this means that the containers must withstand washing or cleaning at a maximum temperature of 90° C., generally at most 80° C., and, in most applications, at a maximum temperature of 70° C. Also at such a low temperature as 70° C., the cleaning result is fully satisfactory to permit refilling the containers.

SUMMARY OF THE INVENTION

One object of the present invention therefore is to provide a method for making containers of plastic, especially PET, which have a reduced tendency to shrink, such that the containers can be reused at least five times, as a rule at least 10 times.

Another object of the invention is to provide a container of plastic which satisfies the above-indicated criteria regarding the tendency to shrink and reusability.

These and other objects, which will appear from the following description, have now been achieved.

The effect aimed at in the invention is achieved by selectively controlled stretching (elongation) of the material when forming the blank or preform into a container, which means that the temperature of the material of the blank immediately before the expansion of the blank into the container is conformed to the desired stretching (elongation) of the material. According to the invention, this is achieved by adjusting the temperature of the different portions of the blank material such that the shoulder of the container or bottle during the expansion is formed substantially only of material which in the blank is located at the upper conical part of the blank. In this manner, the small expansion of the material in the circumferential direction is compensated for by an increased elongation in the axial direction of the blank, such that total stretch of the material, which is defined as the relative elongation in one direction multiplied by the relative elongation in the other direction (biaxial stretch), amounts to values above 2.5. At such a value of the biaxial stretch, the material has been given sufficient orientation to eliminate the tendency of the stretched material to return to its initial shape.

BRIEF DESCRIPTION OF THE DRAWINGS

The invention will now be described in more detail in some non-restrictive embodiments with reference to the accompanying drawings, in which.

DETAILED DESCRIPTION OF THE PREFERRED EMBODIMENTS

Figure 1:
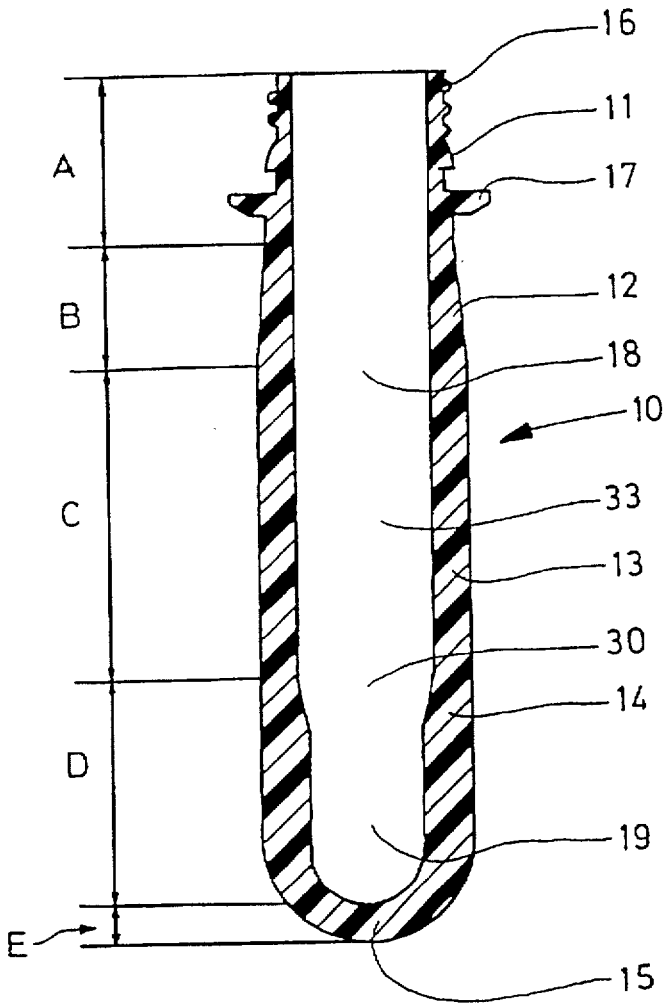
FIG. 1 is an axial section of a preform.
Figure 2:
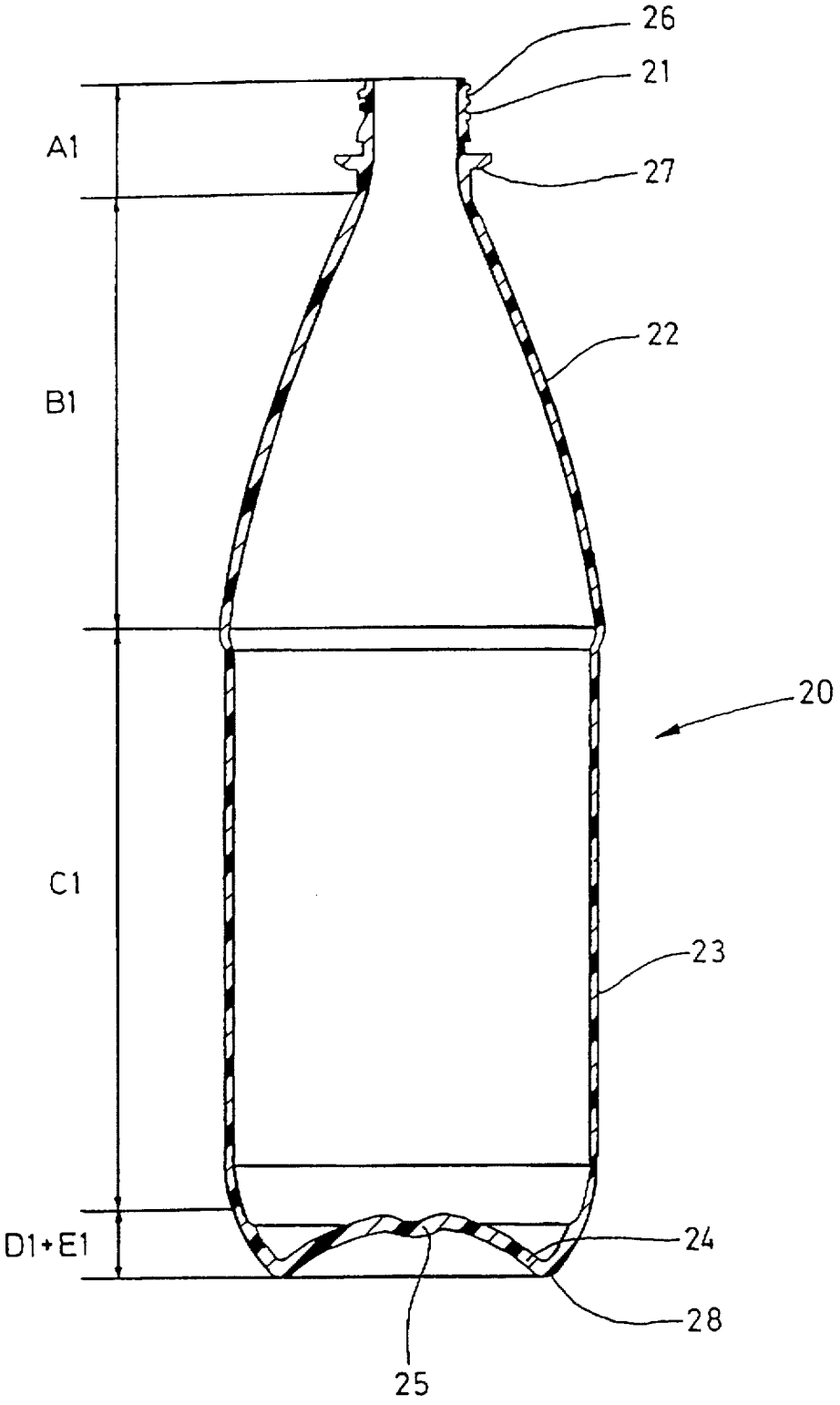
FIG. 2 is an axial section of a container made from the preform.

FIG. 1 shows a blank, also termed preform, of a substantially amorphous thermoplastic material, preferably PET, having a mouth portion 11, a substantially conical portion 12 extending from the mouth portion, a substantially cylindrical portion 13, and a region of material 14 which, when forming the blank 10 into a container 20, forms the bottom 24 of the container (see FIG. 2). The blank 10 has a central cavity 33 with a substantially cylindrical upper portion 18 and a substantially cylindrical lower portion 19, whose circumference is smaller than that of the upper portion 18. The transition between the upper and lower portions 18, 19 of the central cavity is a substantially conical transition portion 30. The cylindrical lower portion 19 is closed at its bottom, which is bulging outwards.

The blank 10 thus serves as starting material in the making of the container 20, which especially is a reusable bottle for beverages.

The mouth portion 11 has a threaded portion 16 and an annular gripping portion 17. The material forming the mouth portion 11 is designated A in FIG. 1. The conical portion 12 encloses the substantially cylindrical upper portion 18 of the central cavity of the blank 10. The conicity of the conical portion 12 results from an increase of the thickness of this portion towards the bottom of the blank 10. The material of the blank 10 forming the conical portion 12 is designated B in FIG. 1.

The proximal part, with respect to the bottom of the blank 10, of the substantially cylindrical upper portion 18 of the cavity 33 of the blank 10 is defined by a wall having a substantially uniform wall thickness in all parts of the cylindrical portion 13 of the blank 10. The region of the substantially cylindrical portion 13 of the blank is marked C in FIG. 1.

The region of material 14, which after reshaping of the blank 10 is intended to constitute the bottom of the container 20, has an increased wall thickness in the region of the transition portion 30 of the cavity of the blank 10, and maintains this wall thickness substantially throughout the entire region of the substantially cylindrical lower portion 19 of the cavity. The wall thickness of the blank 10 thereafter decreases in the closed bottom of the blank to have its minimum thickness in a central region of material 15 in the bottom of the blank 10. Reference D indicates the material of the blank 10 which in the resulting container 20 is reshaped to form part of the bottom of the container, while reference E indicates the material of the blank 10 which substantially retains its shape when forming the container 20.

FIG. 2 shows an embodiment of a container 20 formed by expansion of the blank 10. In FIG. 2, A1, B1, C1, D1, E1 indicate portions of material corresponding to the portions designated A, B, C, D and E in FIG. 1.

The container 20 has a mouth portion 21, a shoulder 22, a substantially cylindrical central portion 23, and a bottom 24. The mouth portion 21 has a shape which substantially agrees with that of the mouth portion 11 of the blank 10.

The shoulder 22 is extended as compared with the length of the substantially conical portion 12 of the blank 10, the quotient of the axial length of the conical portion 12 of the blank 10 and the axial length of the cylindrical portion 13 of the blank 10 having values in the range 0.25–0.35, while the quotient of the axial length of the shoulder 22 and the axial length of the cylindrical portion 23 of the container 20 has values in the range 0.60–0.80. When formed into the container 20, the material is expanded in the circumferential direction of the blank 10 in such a manner that, in the resulting container 20, the material in the region closest to the central cylindrical portion 23 of the container 20 has a total biaxial stretch in the range of about 7–15 times.

The material which in the shoulder 22 is located adjacent the mouth portion 21 of the container 20 will have, when forming the blank 10 into the container 20, a total biaxial stretch in the range 2.5–3.6, preferably 2.7–3.4. In the region between the shoulder 22 and the closed bottom 24 of the container 20, i.e. in the substantially cylindrical central portion 23 of the container 20, the material has undergone, when forming the blank 10 into the container 20, a stretch (elongation) both axially and circumferentially, which means that the material will have a biaxial orientation corresponding to a total biaxial stretch in the range 7–15 times.

The closed bottom 24 of the container 20 has a central bottom portion 25 corresponding to the central portion of material 15 at the bottom of the blank 10, which is designated E in FIG. 1. Further, the bottom 24 consists of material which in FIG. 1 pertains to the portion D. The central bottom portion 25 has substantially the same shape in the container 20 as in the blank 10. However, the material designated D in FIG. 1 has undergone, when forming the blank 10 into the container 20, a certain deformation without being stretched in this connection to such a high degree as to impair the capacity of the material to withstand shrinkage upon heating. In FIG. 2, reference numeral 28 designates the bearing surface of the container 20.

The combination described above of oriented and non-oriented material of the container 20 is achieved by a forming process which is controlled to a great extent by the temperature of the substantially amorphous material in the blank 10 when starting the forming thereof into the container 20. Thus, the mouth portion 21 of the container 20 consists of material which has not undergone any stretching. As to the material in the bottom 24 of the container 20, the stretch is so small that it is of minor importance to the tendency of the container 20 to shrink when heated to the temperatures stated by way of introduction.

As indicated above, the remaining parts of the container 20 consist of biaxially oriented material exhibiting stretch ratios well above the limit at which the tendency of the material to shrink can be eliminated by temperature stabilisation.

To attain the temperature stability aimed at, at least the biaxially oriented material has been engaged with hot mold surfaces while pressurising the interior of the container. As a result, stresses inherent in the biaxial material have been relieved and generally, a certain thermal crystallisation has taken place, and the aimed-at thermal stability of the biaxially oriented material has been achieved.

To conclude, it should be pointed out that the invention is by no means restricted to the embodiments described in the foregoing, but several modifications are conceivable within the scope of the inventive concept as recited in the appended claims. Especially, it should be mentioned that other thermoplastic materials can be used, provided the forming of the blank into the container can be brought about in line with the method of the invention. Examples of such plastic materials are polyethylene naphthalate (PEN), polyacrylnitrile (PAN) and polyamide plastic (PA). Also, it should be pointed out that minor deviations from the ranges stated in the foregoing and in the appended claims are conceivable without departing from the inventive concept.

I claim:

1. A container of plastic material made by forming and expanding a preform, wherein said preform comprises a mouth portion, a substantially conical upper shoulder portion extending in an expanding manner from said mouth portion, a cylindrical central portion extending from said shoulder portion, a transitional portion extending from said cylindrical central portion, and a bottom portion extending from said transitional portion and wherein said container comprises a mouth portion, a shoulder portion extending from said mouth portion, a substantially cylindrical central portion extending from said shoulder portion, and a bottom portion extending from said cylindrical portion, the shoulder portion of said container being formed substantially only of plastic material from the conical shoulder portion of said preform, and the central portion of said container being formed substantially only of plastic material from the cylindrical central portion of said preform, wherein a quotient of an axial length of the conical shoulder portion of said preform divided by an axial length of said cylindrical central portion of said preform has values in an approximate range of 0.25–0.35, a quotient of an axial length of the shoulder portion of said container divided by an axial length of the central portion of said container has values in an approximate range of 0.6–0.8, material of said shoulder portion of said container and said central portion of said container during the expansion being stretched in an axial direction, and wherein the material in the bottom portion of the container, is substantially non-oriented material, and the central bottom portion of the container, that corresponds to the central portion at the bottom of the preform, has substantially the same shape in the container as in the preform.

2. A container as claimed in claim 1, wherein the material of said conical shoulder portion of said preform is expanded in a circumferential direction wherein the material is given a biaxial stretch which in a region closest to said cylindrical central portion of said container is in an approximate range of 7–15.

3. A container as claimed in claim 1, wherein the material of said conical shoulder portion of said preform is expanded wherein said shoulder portion of said container has a biaxial stretch which is in an approximate range of 2.5–3.6.

4. A container as claimed in claim 1, wherein the material of said conical shoulder portion of said preform is expanded wherein said shoulder portion of said container has a biaxial stretch which is in an approximate range of 2.7–3.4.

5. A container as claimed in claim 1, wherein said conical portion of said preform expands from said mouth portion and has a uniform inner diameter, said conical shoulder portion passes uniformly into said cylindrical central portion, said transitional portion has a same outer diameter, but a smaller inner diameter than said central portion, and wall thickness of said bottom portion is less than wall thickness of said transitional portion.

6. A container as claimed in claim 5, wherein a transition from said central portion of said preform to said transitional portion of said preform is substantially conical in shape.

7. A container as claimed in claim 1, wherein when forming the preform into the container, the material in the bottom portion of the container is deformed without being stretched to such a high degree as to impair the capacity of the material to withstand shrinkage upon heating.

* * * * *

UNITED STATES PATENT AND TRADEMARK OFFICE

CERTIFICATE OF CORRECTION

PATENT NO. : 5,750,224

DATED : May 12, 1998

INVENTOR(S) : QUASTERS

It is certified that error appears in the above-identified patent and that said Letters Patent is hereby corrected as shown below:

On the title page insert the following:

Foreign Application Priority Data

--Jul. 1, 1991 [SE] 9102090
Jul. 1, 1992 PCT/SE92/00492--

Please add the following references which were cited during prosecution, and reviewed by the Examiner.

References Cited
U.S. Patent Documents

| | | | |
|---|---|---|---|
| --4,233,022 | Nov., 1980 | Brady et al. | 425/525 |
| 4,264,558 | Apr., 1981 | Jacobsen | 264/523 |
| 4,318,882 | Mar., 1982 | Agrawal et al. | 264/521 |
| 4,380,526 | Apr., 1983 | Agrawal | 264/521 |
| 4,467,929 | Aug., 1984 | Jakobsen et al. | 215/042 |
| 4,485,134 | Nov., 1984 | Jacobsen | 428/36.92 |
| 4,512,948 | Apr., 1985 | Jabarin | 264/521 |
| 4,521,369 | Jun., 1985 | Marcinek | 264/532 |
| 4,550,007 | Oct., 1985 | Ohtsu et al. | 264/521 |
| 4,701,121 | Oct., 1987 | Jakobsen et al. | 426/526 |
| 4,725,464 | Feb., 1988 | Collette | 428/36.92 |
| 4,780,257 | Oct., 1988 | Beck | 264/40.1 |
| 4,880,593 | Nov., 1989 | Strassheimer | 264/532 |

Continued on next page...

UNITED STATES PATENT AND TRADEMARK OFFICE

CERTIFICATE OF CORRECTION

PATENT NO. : 5,750,224

DATED : May 12, 1998

INVENTOR(S) : QUASTERS

It is certified that error appears in the above-identified patent and that said Letters Patent is hereby corrected as shown below:

Foreign Patent Documents

| | | |
|---|---|---|
| 2,321,181 | Nov., 1973 | Germany |
| 1,528,847 | Oct., 1978 | Great Britain |
| 2,040,783 | Jan., 1979 | Great Britain |
| 2,910,609 | Sept., 1980 | Germany |
| 074,246 | Sept., 1982 | Europe |
| WO 83/01766 | May, 1983 | PCT |
| 2,124,543A | Feb., 1984 | Great Britain |
| 106,922 | May, 1984 | Europe |
| WO 84/02874 | Aug., 1984 | PCT |
| 244,128 | Apr., 1987 | Europe |
| G8717822.2 | May 1987 | Germany |
| G8717827.3 | May 1987 | Germany |
| 247,566 | Dec., 1987 | Europe |
| 75,522 | Mar., 1988 | Finland |
| 322,651 | Dec., 1988 | Europe |
| 324,102 | Jul., 1989 | Europe |
| 9-2036-5 | Sept., 1989 | Sweden |
| 9-2037-3 | Sept., 1989 | Sweden |
| 9-2038-1 | Sept., 1989 | Sweden |
| 3,815,193 | Nov., 1989 | Germany |
| 379,264 | Sept., 1990 | Europe |
| 445,465A2 | Nov., 1990 | Europe |
| WO 91/00220 | Jan., 1991 | PCT-- |

UNITED STATES PATENT AND TRADEMARK OFFICE

CERTIFICATE OF CORRECTION

PATENT NO. : 5,750,224

DATED : May 12, 1998

INVENTOR(S) : QUASTERS

It is certified that error appears in the above-identified patent and that said Letters Patent is hereby corrected as shown below:

Other Documents

--Blow Molding Handbook, Donald V. and Dominick V. Rosato, Hanser Publishers, Oxford University Press, New York & Canada--

Please make the following changes to the specification:

--Column 1, line 24, change "zerephthalate" to --terephthalate--.

line 25, change "terephthelate" to --terephthalate--; and

Signed and Sealed this

Twenty-ninth Day of September, 1998

*Attest:*

*Attesting Officer*

BRUCE LEHMAN

*Commissioner of Patents and Trademarks*